United States Patent [19]

Steinberg et al.

[11] Patent Number: 4,874,165

[45] Date of Patent: Oct. 17, 1989

[54] EXECUTIVE BALLS

[76] Inventors: Joseph Steinberg, 1 Verton Ct., East Northport, N.Y. 11779; Raphaela McCabe, 9 Audrey St., Miller Place, N.Y. 11764

[21] Appl. No.: 237,975

[22] Filed: Aug. 29, 1988

[51] Int. Cl.[4] ..... A63F 9/06

[52] U.S. Cl. ..... 273/1 GC; 273/58 E; 273/58 G

[58] Field of Search ..... 273/1 GC, 1 GD, 1 E, 273/1 M, 58 E, 58 G

[56] References Cited

U.S. PATENT DOCUMENTS 3,935,669 2/1976 Potrzuski et al. .:..... 273/58 G X R

FOREIGN PATENT DOCUMENTS 2583648 12/1986 France ..... 273/58 G

OTHER PUBLICATIONS

Radio-Electronics, 12-1971, p. 14, Baseballs Sound Off.

*Primary Examiner*—Paul E. Shapiro

*Attorney, Agent, or Firm*—Leonard Belkin

[57] ABSTRACT

A hand held game device consisting of a pair of spheres one of which contains a permanent magnet and the other of which contains a circuit which is actuated upon the two spheres becoming properly oriented with each other. The circuit containing sphere produces audible beeps upon being actuated. The beeps are produced for a predetermined period of time and are then terminated unless a new series of beeps is initiated upon the two spheres again becoming properly oriented with respect to each other.

10 Claims, 2 Drawing Sheets

EXECUTIVE BALLS

BACKGROUND OF THE INVENTION

This invention relates to a sound producing interactive hand held game device and more particularly to a sound producing interactive hand held game device which when manipulated has the capability of testing the dexterity and eye to hand coordination of the player as well as providing amusement.

There are presently available a variety of sound producing novelty devices such as music boxes and noise making toys such as dolls. In addition, there are toys and novelty items which produce lights under certain conditions, games which provide for atomatic scoring, and balls which produce noises when in use or light up under certain conditions.

Representative of toys and novelty devices of the type mentioned above are those disclosed in U.S. Pat. Nos. 2,530,896, 2,585,153, 3,458,205, 3,555,475, 3,580,575, 4,662,260. None of these patents teaches or suggests the present invention.

SUMMARY OF THE PRESENT INVENTION

In this invention there are provided a pair of spheres or balls capable of being held in one hand which upon manipulation will produce bursts or a series of beeps or tones at successive frequency levels. Production of the beeps is caused by the interactive effect of the two spheres as a result of their manipulation within the hand. Each series or bursts at a particular frequency will continue for a specific period of time, usually a matter of seconds, unless manipulation of the balls within the hand terminates the sequence by initiating a new burst or beeps at a different frequency. How quickly and whether a new series of beeps can be generated is a function of the dexterity of the user and therefore a challenge.

In accordance with a preferred embodiment of the invention one of the spheres contains a permanent magnet and is therefore passive. The active sphere contains a switch reactive to the magnet in the first sphere when properly positioned with respect to the switch in the second or active sphere. When the switch is closed, a sequence of beeps at a particular frequency is initiated and will continue for a predetermined period of time such as about five seconds unless the holder of the two spheres is able to manipulate them into position again where the switch is closed once more and the beeping is terminated and a new sequence at another frequency is initiated. This process can be continued by going up and then down in frequency as long as the player is able to successfully manipulate the spheres.

It is thus a principal object of this invention to provide a novel game device consisting of a pair of spheres or balls manipulated within one hand to challenge the dexterity of the holder of the spheres.

Other objects and advantages of this invention will hereinafter become obvious from the following description of a preferred embodiment of this invention.

DETAILED DESCRIPTION OF THE PREFERRED EMBODIMENTS

Figure 3:
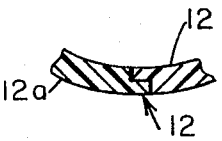
FIG. 3 is a section along 3—3 of FIG. 2.
Figure 2:
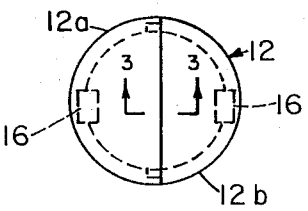
FIG. 2 is a view of the passive sphere.
Figure 1:
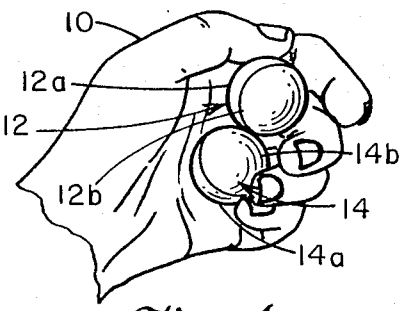
FIG. 1 shows the hand of a user holding two spheres embodying the principles of this invention for manipulating the spheres to carry out the game as described herein.

As shown in FIG. 1, hand 10 of the player holds in his palm a pair of identical looking passive and active hollow spheres or balls 12 and 14, respectively. Each sphere is made from a pair of semi-spherical halves 12*a*, 12*b*, and 14*a*, 14*b*, repsectively, press fit together as shown in FIG. 3 for sphere or ball 12. If desired, an adhesive may also be utilized. Spheres 12 and 14 are made of a suitable rigid plastic material transparent to a magnetic field.

Within sphere 12 are mounted along the inside of the outer wall a pair of permanent magnets 16 for a purpose to be later described. Found to be useful in this system are magnets known in the industry as oriented ceramic magnets.

Sphere 14 contains circuitry for producing the sounds which represent the output of the interactive device made up of spheres 12 and 14.

Figure 4:
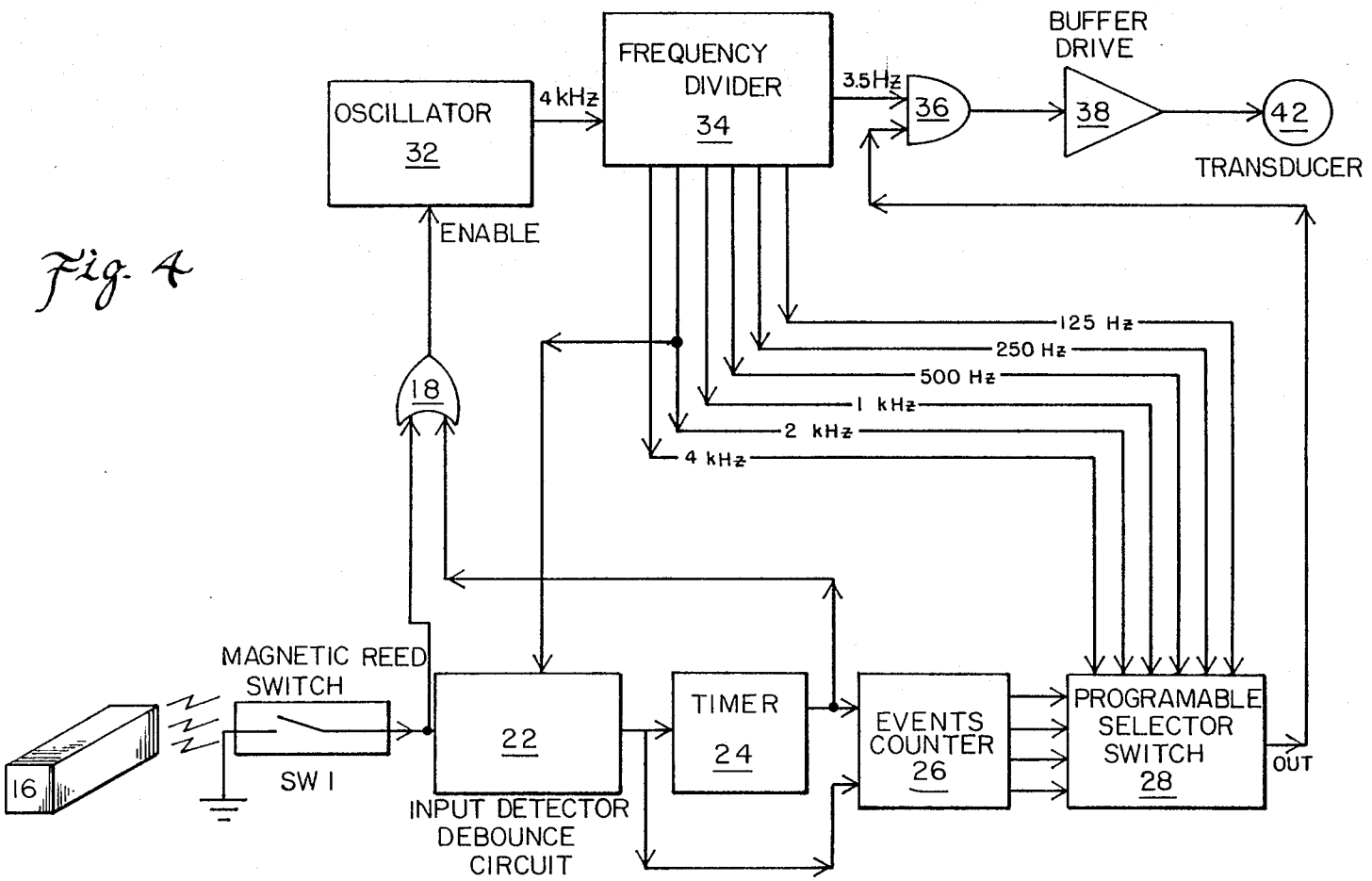
FIG. 4 is a schematic of the active components within the active sphere.

As seen in FIG. 4, the block diagram showing the main data path consists of a magnetic reed switch SW1 which is connected to an OR gate 18 and an imput detector and debounce circuit 22 whose output in turn is delivered simultaneously to a timer 24 and an events counter 26. The latter delivers its binary output through a number of control lines to programmable selector switch 28.

OR gate 18, which also receives an input from timer 24, delivers its signal to oscillator 32 which generates a 4 KHz signal which is passed to frequency divider 34.

The output of divider 34 to be described below and that of switch 28 pass through an AND gate 36 and buffer driver 38 to transducer 42.

A more complete description of the circuit shown in FIG. 4 and its operation is as follows: Close proximity of permanent magnet 16 to magnetic reed input switch SW1 causes it to close and thereby provide an input signal to input detector circuit 22, and through OR gate 18, enabling oscillator circit 32 so that it can provide pulses used for "switch debounce" by input detector circuit 22.

Input detector circuit 22 as seen in the detail logic diagram in FIG. 5 (which will be described later) consists a series of flip-flops and delay circuitry that provides switch debounce based on the oscillator's output, switch input, and internal delays. This prevents multiple inputs caused by switch bounce from effecting events counter 26. The output of input detector circuit 22 goes to both events counter 26 and timer 24.

Timer 24 is a retriggerable mono-stable multi-vibrator that is configured to time out in some particular period of time such as five (5) seconds (if not retriggered). Its output goes to both events counter 26 and to the oscillator enable input through OR gate 18.

Oscillator 32 is a free running multi-vibrator that is enabled during the time that timer 24 is active. This oscillator provides an output of 4 kHz to the input of frequency divider 34. The latter is a 14 stage ripple counter which provides six different frequency outputs to programmable frequency selector switch 28. These are 4 kHz, 2 kHz, 1 kHz, 500 Hz, 250 Hz, and 125 Hz.

Frequency divider circuit 34 also provides a 3.5 Hz signal to one input of the AND gate modulator 36.

Events counter 26 counts input events only during the time that timer 24 remains active (within five seconds of the last event). As each event appears the counter's binary output increments through five binary states (0–5). When timer 24 times out this counter is reset to zero. The binary output of this counter goes to the programmable selector switch 28 and controls which frequency it will pass to its output.

Programmable selector switch 28 output goes to the other input of the AND gate modulator 36. These two signals combine to provide 285.7 millisecond bursts (or beeps) of the frequency that programmable selector switch 28 has selected for as long as timer 24 is active.

The above signal from gate 36 goes to output buffer driver 38 that powers a piezoelectric loud speaker transducer 42 that emits the audio tones that the user hears.

Figure 5:
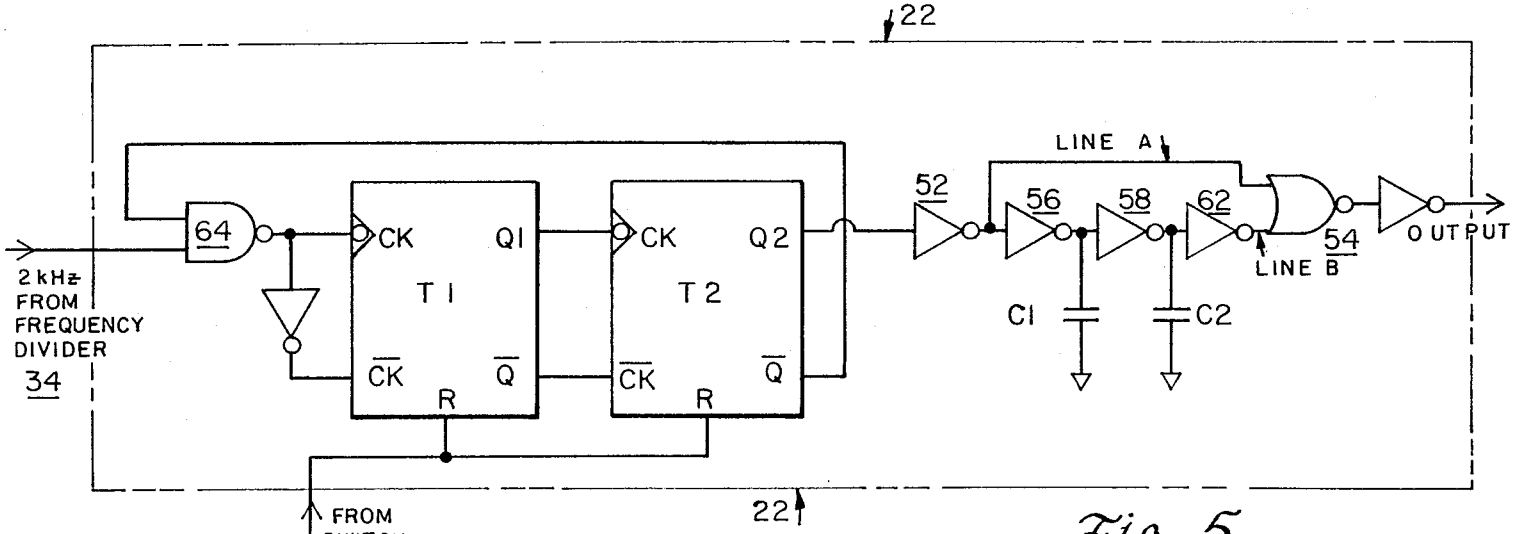
FIG. 5 is a detail of the input detector shown in FIG. 4.

In the operation of input detector circuit 22 shown in FIG. 5, "T" type (toggle) Flip/Fops T1 and T2 are both reset by the output of input switch SW1 (Q1=0) (Q2=0).

Q2 going low produces a "1" at the output of inverter 52. This signal goes to an "OR" gate 54 through two paths: directly through "Line A" and through a delaying path (Line B) consisting of inverters 56, 58, and 62 and capacitors C1 and C2. This has the effect of stretching the signal pulse.

The first negative going transition from the oscillator 32/frequency divider 34 2 kHz output sets "T" flop 1 (Q1=1).

The second negative going transition from the oscillator 32 frequency divider 34 2 kHz output resets "T" Flop 2 (Q2=1) which shuts off the input detector 22 output pulse.

The output of "T" Flop 2 (Q2 NOT="0" going to AND gate 64) blocks further oscillator/divider pulses from toggling "T" Flip 1 until it is reset with a new pulse from input switch SW1.

The details of the various circuits shown are conventional and do not form a part of this invention.

In the operation of the balls shown in FIG. 1, the player manipulates balls 12 and 14 until magnet 16 in ball 12 is positioned with respect to switch SW1 in ball 14 so as to close switch SW1 for a sufficient length of time to produce the first burst or series of beeps as described in connection with FIG. 4. The player continues to manipulate balls 12 and 14 so that magnet 16 is again positioned within the time out period, such as five seconds, of oscillator 32. The goal of the player is to be able to be able to go through as many frequency changes in succession (up and down the scale) without interruption (ie, oscillator 28 becoming disabled). The ability of the player to hear in succession the maximum number of bursts or series of beeps at successive frequencies is largely a measure of the dexterity of the player.

While only a certain preferred embodiment of this invention has been described it is understood that many variations are possible without departing from the principles of this invention as defined in the claims which follow.

What is claimed is:

1. A sound producing game device for challenging the dexterity and coordination of a player comprising:

a. a first sphere containing means for establishing a magnetic field;

b. a second sphere containing switch means for being actuated by said magnetic field when said first and second spheres come within a predetermined position of each other;

c. circuit means in response to actuation of said switch means for producing an audible signal at a preselected frequency, said audible signal terminating after a predetermined period of time after initiation of said audible signal; and d. said circuit means including means in response to the repeated actuation of said switch means within said predetermined period of time to initiate another audible signal at a different preselected frequency, the other audible signal terminating after said predetermined time measured from the initiation of said other audible signal unless said switch means is again actuated and initiates a new audible signal at a different frequency.

2. The game device of claim 1 in which said circuit means includes means to produce a series of audible signals at a succession of frequencies rising and dropping in scale as long as said switch means is actuated within said predetermined period of time due to said spheres coming within said predetermined position after each audible signal is initiated.

3. The sound producing game device of claim 2 in which said circuit means includes:

a. oscillator means for being enabled by the actuation of said switch means to produce a constant frequency output;

b. frequency divider means for producing in response to the output of said oscillator means a plurality of different frequency outputs; and c. means to select which frequency output from said divider means produces an audible signal at a frequency corresponding to the frequency of the output selected from said divider means.

4. The sound producing device of claim 3 in which said divider means also produces an output for being gated with the frequency output selected to produce said audible signals in the form of beeps.

5. The sound producing device of claim 4 in which said circuit means includes a piezoelectric crystal device to produce the audible signals.

6. The sound producing game device of claim 1 in which said means for establishing a magnetic field comprises at least one permanent magnet.

7. The sound producing game device of claim 6 in which said switch means is a magnetic reed switch.

8. The sound producing game device of claim 7 in which said spheres are made from material transparent to a magnetic field.

9. The sound producing game device of claim 8 in which said first and second spheres are small enough to fit in the palm of a hand and be manipulated thereby.

10. The sound producing game device of claim 9 in which said circuit means includes a piezoelectric crystal device to produce the audible signals.

* * * * *